United States Patent [19]

Renger

[11] 4,215,820

[45] Aug. 5, 1980

[54] INJECTION DEVICE FOR AN INTERNAL COMBUSTION ENGINE

[75] Inventor: Udo Renger, Wolfsburg, Fed. Rep. of Germany

[73] Assignee: Volkswagenwerk Aktiengesellschaft, Fed. Rep. of Germany

[21] Appl. No.: 902,362

[22] Filed: May 3, 1978

[30] Foreign Application Priority Data

May 5, 1977 [DE] Fed. Rep. of Germany ..... 2720144

[51] Int. Cl.[2] ..... B05B 1/30

[52] U.S. Cl. ..... 239/90; 239/125; 239/533.7; 239/585

[58] Field of Search ..... 239/88–92, 239/125, 126, 132, 132.5, 453, 533.2–533.7, 533.9, 533.12, 584, 585

[56] References Cited

U.S. PATENT DOCUMENTS

| | | | |
|---|---|---|---|
| 2,571,501 | 10/1951 | Truxell | 239/533.7 X |
| 2,628,866 | 2/1953 | Purchas et al. | 239/90 |
| 2,912,168 | 11/1959 | L'Orange | 239/125 X |
| 3,721,390 | 3/1973 | Jackson | 239/585 |
| 3,817,456 | 6/1974 | Schlappkohl | 239/533.5 |

*Primary Examiner*—Johnny D. Cherry
*Attorney, Agent, or Firm*—Brumbaugh, Graves, Donohue & Raymond

[57] ABSTRACT

An injection device having at least one injection nozzle arrangement for intermittent discharge of a prescribed quantity of fuel. The nozzle arrangement is actuatable in response to an increased fuel pressure in the nozzle arrangement, and has an inlet communicating with the nozzle arrangement for supplying fuel. An outlet communicates with the nozzle arrangement for partial return of the fuel to provide a flow of fuel through the nozzle arrangement and thus uniflow scavenging and cooling of the injection device. The flow of fuel is limited between the inlet and outlet at least temporarily to allow an increase in fuel pressure required to actuate the nozzle arrangement.

4 Claims, 2 Drawing Figures

INJECTION DEVICE FOR AN INTERNAL COMBUSTION ENGINE

BACKGROUND OF THE INVENTION

The invention is an injection device for injecting fuel into an engine and includes an arrangement wherein there is a flow of fuel through the injection device at least when it is not injecting fuel into the engine. This flow provides uniflow scavenging and cooling of the injection device and prevents vapor lock.

Fuel injection devices are most commonly used for gasoline injection in internal combustion engines of motor vehicles. Fuel is provided through an inlet to a nozzle arrangement which is screwed into the cylinder or cylinder head of the engine. This part of the engine is subject to high temperatures when the engine is operating, and the materials used for the nozzle arrangement are normally heat conductors so that there is a danger of at least partial evaporation of the fuel in the nozzle arrangement awaiting injection. Such evaporation is undesirable since it increases the pressure in the nozzle arrangement, and may impede or prevent the subsequent supplying of fuel to the nozzle.

This problem may be prevented by providing additional means for cooling the nozzle system, or if the nozzle system is used together with an injection pump, for cooling of the combined unit. It would be desirable however, to provide an arrangement for preventing the formation of vapor lock in the nozzle arrangement or the combined nozzle and pump, which would utilize the existing structure of the nozzle arrangement and not require any additional components or alterations.

SUMMARY OF THE INVENTION

In accordance with the present invention, an injection device which has a nozzle actuatable in response to an increased fuel pressure in the nozzle arrangement, and which has an inlet communicating with the nozzle arrangement for supplying fuel into the nozzle arrangement, is provided with an outlet communicating with the nozzle arrangement for partial return of the fuel supplied to the nozzle. This provides a flow of fuel through the nozzle arrangement at times when the nozzle is not actuated. There are also means provided which limit the flow between the inlet and outlet at least temporarily to allow an increase in fuel pressure as required when it is desirable to actuate the nozzle. In one preferred embodiment, the flow is limited through the use of a critical flow-through throttle which is located at the outlet of the fuel from nozzle. In another arrangement, where the nozzle arrangement is used together with a pump, the pump is arranged so that the outflow of fluid from the nozzle arrangement to the return line is blocked when the piston is actuated to increase the fuel pressure in the nozzle arrangement and thus inject the fuel into the engine.

The resulting flow of fuel through the nozzle arrangement provides uniflow scavenging, that is, a flushing of the nozzle without any reversal of flow which, due to the inertia of the flowing medium could possibly be utilized in slow operating nozzle arrangements. This flow of fuel through the nozzle also acts to assure heat abdication from the nozzle arrangement, or the nozzle-pump arrangement, with the fuel utilized as a heat carrier medium. The arrangement acts as a bypass to the nozzle valve proper to ensure uniflow scavenging, while at the same time allowing an increase in fluid pressure as required to actuate the nozzle system, that is, to open the nozzle needle valve. In the case of an arrangement having a critical flow-through throttle opening, pressure in the nozzle arrangement will not be impeded by the provision of this valve, since the fluid flow through this type of valve is independent, practically speaking, of the pressure on its input side. As used herein, the term "critical flow-through throttle" refers to these types of constant flow, pressure independent constructions, which are known per se. They are generally in the form of a narrow constriction or tube providing considerable resistance to flow over its length, the length to width ratio designed appropriately to result in such constant flow through. The pressure increase effected to open the injection nozzle, for example from a liquid hydraulic pump associated with the nozzle, will for all practical purposes remain unaffected by the fact that flow through the throttle continues to the outlet even when the pressure is increased in the nozzle arrangement. In this embodiment of the invention there will be a constant uniflow scavenging of fuel.

In the embodiment wherein the outflow of fluid from the nozzle to the outlet is blocked when the nozzle is actuated, there will be temporary uniflow scavenging between injections, but the flushing flow will be interrupted at times when the nozzle is opened, that is, during the delivery of the prescribed fluid quantity by the nozzle system.

In either of the preferred embodiments discussed above, fuel is introduced into the nozzle arrangement through an axially extending delivery duct formed in the pump piston of the pump. The inlet flow will be delivered into a chamber, where it is either partially circulated out through the outlet through the critical flow-through valve or the unblocked outlet opening in the vicinity of the pump piston, or out through the nozzle into the engine during delivery time. The outlet end of this duct is provided with a one-way suction valve which permits the flow of fluid into the chamber during times when the piston is not actuated. When the piston is actuated, a slight increase in pressure in the chamber will cause the valve to close preventing backflow of the fluid through the duct. As a further deterent to the prevention of vapor lock in the vicinity of the delivery duct, which could cause the valve to close prematurely thus impeding the delivery of fluid to the nozzle chamber, the chamber may be subdivided into one chamber adjacent the delivery duct, and the second chamber adjacent the nozzle. A pressure valve is interposed between the two chambers which will normally be open and allow the free flow of fuel between the two chambers, but which will close with increased pressure in the second chamber, that is, in the chamber adjacent the nozzle.

Thus, when vaporization of the fuel takes place in the lower chamber adjacent the nozzle, the increase in pressure resultant therefrom will close the pressure valve and prevent the gas from passing through into the upper chamber adjacent the delivery duct. This will prevent the formation of vapor lock in the chamber adjacent the delivery duct, and thus not interfere with the delivery of the fuel to the nozzle chamber. This will be especially useful in an arrangement where there is a critical flow-through throttle in the vicinity of the pressure valve which leads from the chamber of the nozzle arrangement to conduits which are constantly connected with the fluid outlet.

BRIEF DESCRIPTION OF THE DRAWINGS

For a better understanding of the present invention, reference is made to the following drawings, and the accompanying Description of the Preferred Embodiment in which.

DESCRIPTION OF THE PREFERRED EMBODIMENTS

Figure 1:
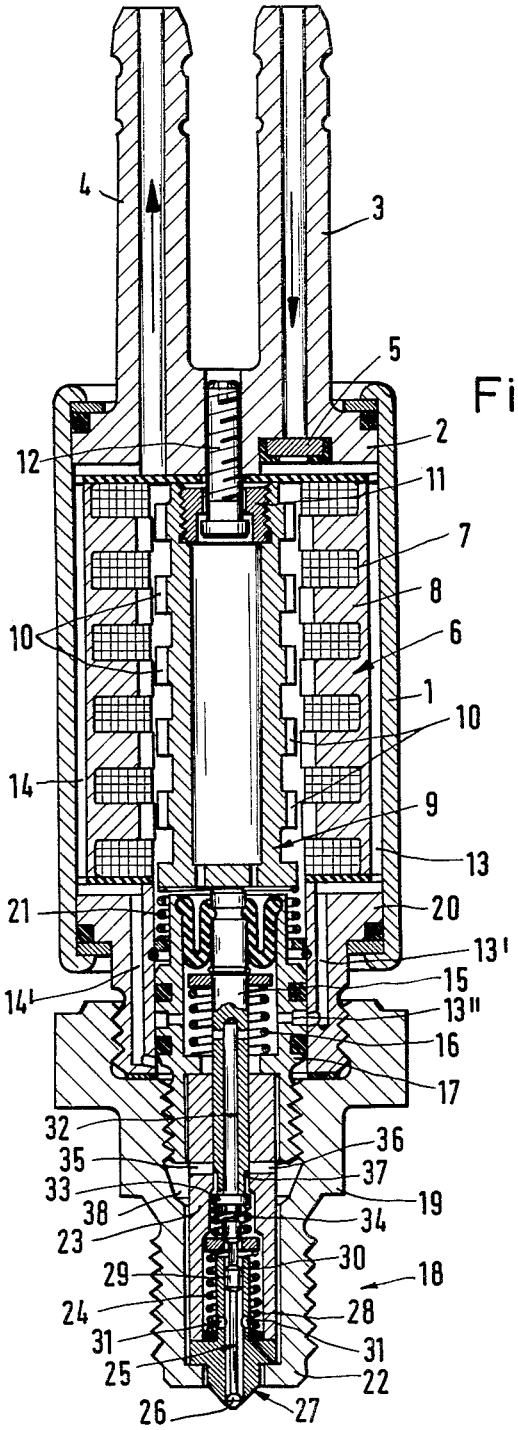
FIG. 1 is a longitudinal sectional view of one embodiment of a pump-nozzle arrangement for constant-volume injection into an engine according to the present invention.

Referring to FIG. 1, the pump-nozzle arrangement comprises a cylindrical housing 1, which contains a tightly arranged cap 2 at its upper end having a fluid delivery socket 3 and fluid discharge socket 4. At the inlet side, a screen or filter 5 is interposed in the fluid delivery path. The cylindrical housing 1 also contains an actuating system 6, a magnetic arrangement, made up of a soft iron sleeve 8 carrying magnet windings 7 as well as a longitudinally-displaceable armature 9 with a plurality of poles 10. The actuating system is operable upon delivery of an electric current to the windings 7, the armature moving longitudinally, that is, downward as shown in FIG. 1, until the sleeve 11 lodges at its upper end against the rear edge of an adjusting screw 12 partially screwed into the cap 2. Thus the elements 11 and 12 define the stroke of the armature 9. A construction of the actuating device 6 comprising double thread screwed windings has been found to be especially suitable.

Also contained in the cylindrical housing are at least one duct 13 connected with the fluid delivery socket 3 and one duct 14 connected with the discharge outlet 4. These ducts are located outside the actuating device 6 so as not mutually to interfere.

The lower end of the armature 9, which has a plane end face, is faced by the end face of a pump piston 15, which is biased upwardly by a pressure spring 16 supported by a sleeve 17. The sleeve 17 is screwed into a lower cap 19 forming the housing of the nozzle arrangement 18. The lower cap 19, in turn, is screwed together with another sleeve 20, which also closes off the bottom of the cylindrical housing 1. The ducts 13 and 14 extend through the component 20, as indicated by 13' and 14'.

The component 20 also supports a pressure spring 21 which constitutes a return spring for the armature 9, biasing it upwardly. Various points of the arrangement are provided with seals, partly in the form of ring seals, partly in the form of packings.

Between the sleeve 17 and the narrowed down part 22 at the bottom end of the cap 19, a sleeve-like prolongation 23 of element 17 is secured. The prolongation 23 forms in its upper region a guide for the pump piston 15, and in its expanded lower region defines a chamber 24 of the nozzle arrangement 18. In order to avoid the formation of vapor lock, it is desirable to keep this chamber as small as possible. Disposed within the chamber 24 is a nozzle needle 25 which has a flared lower portion 26 which bears on a valve seat 27, and the needle is biased upwardly, closed, by a spring 28. A guide reinforcement 29 is provided on the nozzle needle 25 which is supported by a prolongation 30 forming a part of component 27. This component 27 has several fluid inlet openings 31 formed in the prolongation 30 through which the fuel can enter the ring space between parts 25 and 27; thus the fuel which is in the ring space can be injected in a downward direction into the cylinder when the nozzle arrangement is actuated.

Fuel entering through the fluid delivery socket 3 is fed through the inlet duct 13' and continues into a cross duct 13" which communicates with an axially-extending duct 32 in the pump piston 15. At the outlet end of the duct 32 a valve disc 33 bears on the lower end of the pump piston, such valve disc forming a part of a one-way suction valve which also includes a weak closing spring 34. The suction valve is designed so that it will open in response to pressure provided by the fluid in the longitudinal duct 32 outside of the discharge times of the nozzle arrangement 18, wherein increased pressure in the chamber will close the valve.

A pair of outlet openings 35 and 36 in component 23 are selectively opened and closed by pump piston 15. The pump piston 15 has a control edge 37 formed such that the flow communicates from the nozzle arrangement, e.g. the chamber 24, out through the openings 35 or 36 along the control edge 37 when the pump piston 15 is retracted, that is at its upper position between delivery times. The openings 35 and 36, however, will be blocked by the pump piston 15 when the piston 15 is actuated downwardly for delivery of fuel through the nozzle 25. The openings 35 and 36 in turn are connected to a ring duct 38, which connects with the outlet duct 14' e.g. through a clearance in the threading between the sleeve 17 and the cap 19.

Accordingly, the device illustrated in FIG. 1 is actuated by energizing the actuating device 6, thereby longitudinally displacing the pump piston in a direction towards the nozzle arrangement, that is, downwardly. During this displacement, the suction valve 33, 34 is closed and the pressure in the chamber which now increases from the decreased volume in the chamber, results in the movement of the nozzle needle 25 in a downward direction, and opening of the nozzle valve 26, 27 proper. Thus the fuel quantity present in the chamber 24 will be ejected into the engine.

In the intervals between injections, the pump piston 15 will be in the position shown in FIG. 1. The control edge 37 produces a connection between openings 35 and 36 and the chamber 24 of the nozzle arrangement 18. Thus there is a constant flow of fluid between the delivery 3 and the discharge 4 and thereby an on-going cooling of the chamber 24 and other areas of the pump-nozzle device. The scavenging effect of the flow also constantly removes any trapped gas, air or vapor locks which may form in the chamber 24 or in other zones of the device through which the flow passes. The discharge 4 may be connected directly with a tank for the fluid. During delivery times of the nozzle arrangement, however, the pump piston 15 blocks the openings 35 and 36 so that when a comparatively high pressure must be generated in the chamber 24 for actuating of the nozzle arrangement, that is, forcing the nozzle needle downward to open the chamber, such pressure build up is not impaired by fuel flowing out the outlet.

Figure 2:
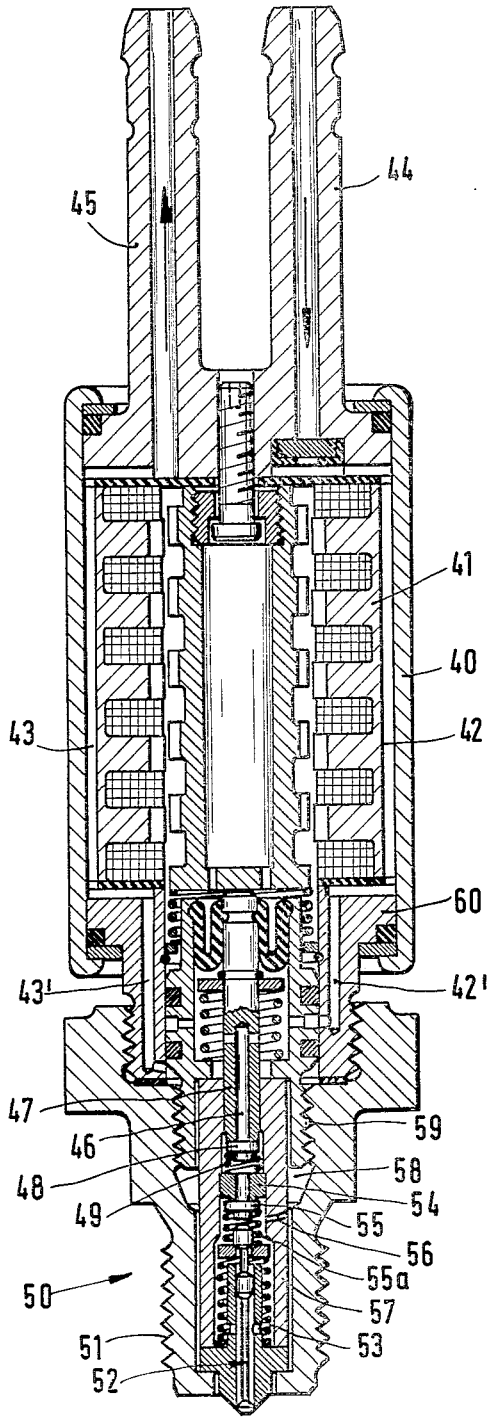
FIG. 2 is a longitudinal sectional view through another embodiment of a pump-nozzle arrangement for constant-volume injection into an engine according to the present invention.

Another embodiment of the present invention is shown in FIG. 2. In this arrangement, there is provided, rather than intermittent scavenging and cooling, a constant flow of fuel through the nozzle arrangement to provide such scavenging. The device is similar to that shown in FIG. 1 comprising a cylindrical housing 40, an electromagnetic actuating device 41, which may be identical to that shown in FIG. 1, and at least one delivery duct 42 and discharge duct 43 which are in communication with the inlet 44 and outlet 45. The inlet and outlet are provided with extensions 42' and 43' respectively in the component 60 closing off the bottom of the housing 40. The delivery duct 42' connects with an axially-extending duct 46 in the pump piston 47, and the axially-extending duct 46 is again provided with a one-way suction valve consisting of a valve disc 48 bearing on the end face of the pump piston 47, and a closing spring 49.

The nozzle arrangement 50, as does the arrangement in FIG. 1, contains a lower cap 51, and a nozzle needle 52 which is designed in a manner similar to that of the corresponding element of the embodiment in FIG. 1.

The chamber 53 of the nozzle arrangement 50 is subdivided into two parts by a pressure valve formed by an inset 54, a valve disc 55 and a closing spring 55*a*. This pressure valve is disposed in the chamber between the suction valve 48, 49 and the nozzle needle 52, and prevents vapor lock created in the chamber 53, e.g., through heat transfer from a cylinder into the cap 51, from reaching the zone of the suction valve 48, 49. This arrangement will assure that any increase in pressure in the lower chamber due to formation of vapor does not reach the suction valve, and that such valve at all times operates at opposition to a fluid pressure, but not to an increased vapor pressure.

The device according to FIG. 2 also contains an arrangement which ensures uniflow scavenging of the chamber 53 of the nozzle arrangement and other ducts of the device. In this case, the outlet of fuel flowing through the nozzle arrangement passes through a critical flow-through throttle 56 in the sleeve-like part 57 enclosing the chamber 53. The critical flow-through throttle 56 opens into a ring duct 58 which in turn opens into a discharge duct 43' e.g., through a clearance in the threading 59.

Thus, the chamber 53 is always in communication with the outlet 45 through the critical flow-through throttle 56. When both valve discs 48 and 55 are open, uniflow scavenging will occur. If, upon a pressure increase in the lower part of the chamber 53, e.g. due to vaporization of gases in the chamber 53, the pressure valve 55 closes, uniflow scavenging will be temporarily interrupted, since fuel will not be flowing from the inlet duct 46 into the lower chamber 53. However, the presence of the throttle 56 will cause a pressure relief resultant from any vapor lock. Thereafter, the pressure valve will re-open and uniflow scavenging will resume.

In this arrangement, the throttle 56 will not be blocked during times when it is necessary to increase pressure in the chamber 53 in order to actuate the nozzle, however is not necessary due to the design of the throttle 56. During the discharge time for the nozzle arrangement, the presence of the throttle 56 will not impair the buildup of pressure in the chamber 53 necessary for longitudinal displacement of the nozzle needle insofar as the flow of fluids through a critical flow-through throttle is for the most part independent of the pressure on its inlet side.

Thus, in either of the aforementioned arrangements, the invention at most requires the formation of additional ducts in presently used components, and does not entail any additional construction effort. It is thus possible to retain a very small nozzle chamber. The invention can also be utilized if there is no combined pump-nozzle unit, but only the nozzle itself is in a heat transfer connection with the cylinder of the internal combustion engine.

It is notably important that the invention ensures uniflow scavenging, i.e., that no change in the flow direction occurs either during the actuation of the device or during the intervals in which the device is not actuated. The buildup of pressure required to actuate the nozzle arrangements remains unaffected in that means are provided in the path of the uniflow scavenging which limits the flow at least temporarily. In the embodiment described in connection with FIG. 1, the control edge arrangement suspends the uniflow scavenging during delivery times of the nozzle arrangement completely or at least largely to permit the build-up of pressure, and in the embodiment described in connection with FIG. 2, the critical flow-through throttle inherently allows a pressure build-up in the chamber as is required.

The embodiments of the invention described herein are merely illustrative, and the invention may be embodied in other forms while still employing the inventive principles contained herein. Other such modifications and variations will be apparent to those skilled in the art. All such modifications and variations are intended to be within the scope of the invention as defined in the following claims.

I claim:

1. In an injection device having at least one injection nozzle arrangement with a nozzle for intermittent discharge of a prescribed quantity of fuel, the nozzle arrangement being actuatable in response to an increased fuel pressure therein, and having an inlet communicating with said nozzle arrangement for supplying fuel thereto; the improvement comprising an outlet communicating with said nozzle arrangement for partial return of said fuel supplied thereto to provide a flow of fuel through said nozzle arrangement, and means for limiting said flow between said inlet and outlet at least temporarily to allow an increase in fuel pressure required to actuate said nozzle arrangement, wherein said nozzle arrangement is provided with a chamber and said flow limiting means comprises a critical flow-through throttle communicating with said chamber, wherein said injection device has a pump upstream of said chamber comprising a pump piston which is axially displaceable for actuating said nozzle arrangement, said piston having an axially-extending delivery duct connected to said inlet, and wherein suction valve means are provided at the outlet end of said delivery duct adapted to remain open on normal pressure in said chamber and to close in response to increased fuel pressure in said chamber.

2. In an injection device having at least one injection nozzle arrangement with a nozzle for intermittent discharge of a prescribed quantity of fuel, the nozzle arrangement being actuatable in response to an increased fuel pressure therein, and having an inlet communicating with said nozzle arrangement for supplying fuel thereto, the improvement wherein said nozzle arrangement is provided with a chamber and said injection device has a pump upstream of said chamber comprising a pump piston which is axially displaceable for actuating said nozzle, said piston having an axially-extending delivery duct connected to said inlet, wherein suction valve means are provided at the outlet end of said delivery duct adapted to remain open on normal pressure in said chamber and to close in response to increased fuel pressure in said chamber, and wherein a pressure valve means is disposed in said chamber between said suction valve means and said nozzle, dividing said chamber into two parts, a first part adjacent said piston and a second part adjacent said nozzle, said pressure valve means normally open to permit fuel to flow from said first part into said second part, and adapted to close when the pressure in said second part exceeds that in said first part.

3. In an injection device having at least one injection nozzle arrangement with a nozzle for intermittent discharge of a prescribed quantity of fuel, the nozzle arrangement being actuatable in response to an increased fuel pressure therein, and having an inlet communicating with said nozzle arrangement for supplying fuel thereto; the improvement comprising an outlet communicating with said nozzle arrangement for partial return of said fuel supplied thereto to provide a flow of fuel through said nozzle arrangement, and means for limiting said flow between said inlet and outlet at least temporarily to allow an increase in fuel pressure required to actuate said nozzle arrangement, wherein said nozzle arrangement is provided with a chamber, said injection device has a pump upstream of said chamber comprising a piston, said piston axially displaceable between first and second positions for actuating said nozzle and having an axially-extending delivery duct connected to said inlet, said piston having a control edge formed therein, wherein said means for limiting said flow comprises at least one opening connected with said outlet, said opening and said piston arranged such that said flow communicates from said nozzle arrangement out through said opening along said control edge when said piston is in its first position, and said opening is blocked by said piston when said piston moves into its second position, and wherein suction valve means are provided at the outlet end of said delivery duct adapted to remain open on normal pressure in said chamber, and to close in response to increased fuel pressure in said chamber.

4. A device according to claim 1 or 3, wherein a pressure valve means is disposed in said chamber between said pump and said nozzle, dividing said chamber into two parts, a first part adjacent said piston and a second part adjacent said nozzle, said pressure valve means normally open to permit fuel to flow from said first part into said second part, and adapted to close when the pressure in said second part exceeds that in said first part.

* * * * *